US008181424B2

(12) United States Patent
Rosenkranz

(10) Patent No.: US 8,181,424 B2
(45) Date of Patent: May 22, 2012

(54) INSERTER CONTROL APPARATUS

(75) Inventor: Thomas H. Rosenkranz, Dover Plains, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 13/075,206

(22) Filed: Mar. 30, 2011

(65) Prior Publication Data

US 2011/0203224 A1 Aug. 25, 2011

Related U.S. Application Data

(63) Continuation of application No. 11/962,804, filed on Dec. 21, 2007, now Pat. No. 7,930,869.

(51) Int. Cl.
*B43M 3/04* (2006.01)
*B65B 59/00* (2006.01)

(52) U.S. Cl. ..... 53/55; 53/504; 53/250; 53/381.5

(58) Field of Classification Search ..... 53/396, 53/460, 468, 473, 492, 55, 58, 64, 504, 569, 53/284.3, 381.5–381.7, 250; 270/58.06; 700/220, 230; *B43M 3/04*
See application file for complete search history.

(56) References Cited

U.S. PATENT DOCUMENTS 2,325,455 A * 7/1943 Williams ..... 53/381.7
4,091,596 A 5/1978 Jones
4,634,107 A * 1/1987 Vandersyde et al. ..... 270/56
4,903,456 A 2/1990 Meur
4,987,547 A 1/1991 Rabindran et al.
5,327,701 A 7/1994 Dronsfield
5,467,577 A 11/1995 Sato
5,518,228 A * 5/1996 Bodie et al. ..... 270/58.08
5,561,962 A 10/1996 Everhard et al.
5,926,391 A 7/1999 Qutub et al.
5,941,516 A 8/1999 Emigh et al.
5,949,687 A 9/1999 Emigh et al.
(Continued)

FOREIGN PATENT DOCUMENTS

EP 267608 A2 5/1988
(Continued)

OTHER PUBLICATIONS

Machine translation of EP 1332891 A1, retrieved from htpp://translationgateway.epo.org/emtp/gw/?ACTI...MAT=docdb&COUNTRY=EP&NUMBER=1332891&KIND=A1&T=1,Dec. 9, 2010, 6 pages.

*Primary Examiner* — Stephen F Gerrity
(74) *Attorney, Agent, or Firm* — Michael J. Cummings; Charles R. Malandra, Jr.; Steven J. Shapiro

(57) ABSTRACT

An inserter apparatus for inserting an item into a holder. The inserter apparatus includes a deck, a mover, an opening system, and a controller. The deck can slidably support the holder from a first location to an item loading location. The mover can move the holder along the deck, wherein the mover includes a drive motor, a conveyor connected to the drive motor, and a gripper connected to the conveyor. The drive motor is a servo motor. The opening system is at the item loading location for opening the holder and inserting the item into the holder. The controller is connected to the servo motor. The controller is adapted to vary speed of the servo motor to thereby vary speed of the conveyor and the holder along the deck.

8 Claims, 5 Drawing Sheets

U.S. PATENT DOCUMENTS

| | | | | |
|---|---|---|---|---|
| 6,164,046 | A | 12/2000 | Werner et al. | |
| 6,168,008 | B1 * | 1/2001 | Sting et al. | 198/461.3 |
| 6,601,364 | B2 * | 8/2003 | Sussmeier | 53/52 |
| 6,802,504 | B2 * | 10/2004 | DePoi et al. | 271/259 |
| 2002/0112453 | A1 | 8/2002 | Rivenbark et al. | |
| 2003/0182899 | A1 | 10/2003 | Sting et al. | |
| 2005/0072127 | A1 | 4/2005 | Botschek et al. | |
| 2006/0218877 | A1 * | 10/2006 | Brauneis et al. | 53/284.3 |
| 2009/0000098 | A1 | 1/2009 | Campbell | |

FOREIGN PATENT DOCUMENTS

| | | | |
|---|---|---|---|
| EP | 2284793 | A | 6/1995 |
| EP | 1332891 | A1 | 8/2003 |
| JP | 05035030 | A | 2/1993 |

* cited by examiner

INSERTER CONTROL APPARATUS

RELATED APPLICATION

This application is a continuation of U.S. patent application Ser. No. 11/962,804, filed Dec. 21, 2007, now U.S. Pat. No. 7,930,869.

FIELD OF THE INVENTION

The invention relates to an inserter for inserting an item into a holder and, more particularly, to control of movement of the holder in the inserter.

BACKGROUND OF THE INVENTION

Conventional mail piece inserter designs include a gripper chain, a mechanical index box, and a simple constant rotational speed AC motor that powers the system. In such devices, the gripper chain is driven fifty percent (50%) of the cycle and is stopped fifty percent (50%) of the cycle. When the gripper chain is stopped, the envelope is prepared (grippers open, insertion cups open the envelope, and the fingers are inserted), and then the mail piece item (e.g., collation) is inserted. The gripper chain is stopped the same amount of time (fifty percent of the cycle) whether the inserter is inserting a collation having the minimum depth collation (such as 3.7 inches, for example) or the maximum depth collation (such as 9.5 inches, for example). Thus, in conventional inserters, when inserting a collation smaller than the maximum size collation (9.5 inches in the example above), there is a wasted portion of the cycle when the gripper chain is stopped after the collation has been inserted, and prior to the beginning of the next cycle.

There is a desire to provide an apparatus and method which allows for either faster throughput when the inserter is being used with collations smaller than the maximum size collation, and/or which allows for slower operating speeds of the gripper chain when the inserter is being used with collations smaller than the maximum size collation.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with one aspect of the invention, an inserter apparatus for inserting an item into a holder is provided. In one embodiment, the holder comprises an envelope. Other types of holders may also be used. The inserter apparatus includes a deck, a mover, an opening system, and a controller. The deck can slidably support the holder from a first location to an item loading location (e.g., insertion area). The mover can move the holder along the deck, wherein the mover includes a drive motor, a conveyor connected to the drive motor, and a gripper connected to the conveyor. The drive motor is a servo motor. In one embodiment, the servo motor is a position-based servo motor. Other types of servo motors may also be used. The opening system is at the item loading location for opening the holder and inserting the item into the holder. The controller is connected to the servo motor. The controller is adapted to vary speed of the servo motor to thereby vary speed of the conveyor and the holder along the deck.

In accordance with another aspect of the invention, a method of controlling insertion of an item into a holder in an inserter apparatus is provided comprising determining an insertion time for inserting the item into the holder at an item loading location, wherein the inserter apparatus comprises a conveyor which moves the holder to the item loading location, and wherein the conveyor stops while the item is being loaded into the holder at the item loading location; and varying a) the time during which the conveyor is stopped at the item loading location and/or b) the speed of the conveyor while the conveyor is moving, by controlling a servo motor drive connected to the conveyor based at least partially upon the determined insertion time.

In accordance with another aspect of the invention, a method of controlling sequential insertion of items into holders, respectively, in an inserter apparatus, wherein the inserter apparatus comprises a conveyor that sequentially moves the holders to an item loading location, and wherein the conveyor stops while each of the items is being sequentially inserted into each of the respective holders at the item loading location is provided. The method comprises determining a time duration for a stop of the conveyor for full insertion of one of the items into one of the holders at an item loading location; moving the conveyor, stopping the conveyor for the time duration, and repeating the moving and stopping, wherein moving the conveyor comprises moving a servo motor connected to the conveyor; and controlling the speed of the servo motor to at least partially control movement of the conveyor.

In accordance with another aspect of the invention, a program storage device is provided which is readable by a machine, tangibly embodying a program of instructions executable by the machine for performing operations to control movement of an envelope in an inserter apparatus, the operations comprising determining an insertion time for inserting an item into the envelope at an item loading location; and varying movement of an envelope conveyor of the inserter apparatus by controlling a servo motor drive connected to the envelope conveyor based upon the determined insertion time.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The foregoing aspects and other features of the invention are explained in the following description, taken in connection with the accompanying drawings, wherein.

DETAILED DESCRIPTION OF EXEMPLARY EMBODIMENTS

Figure 1:
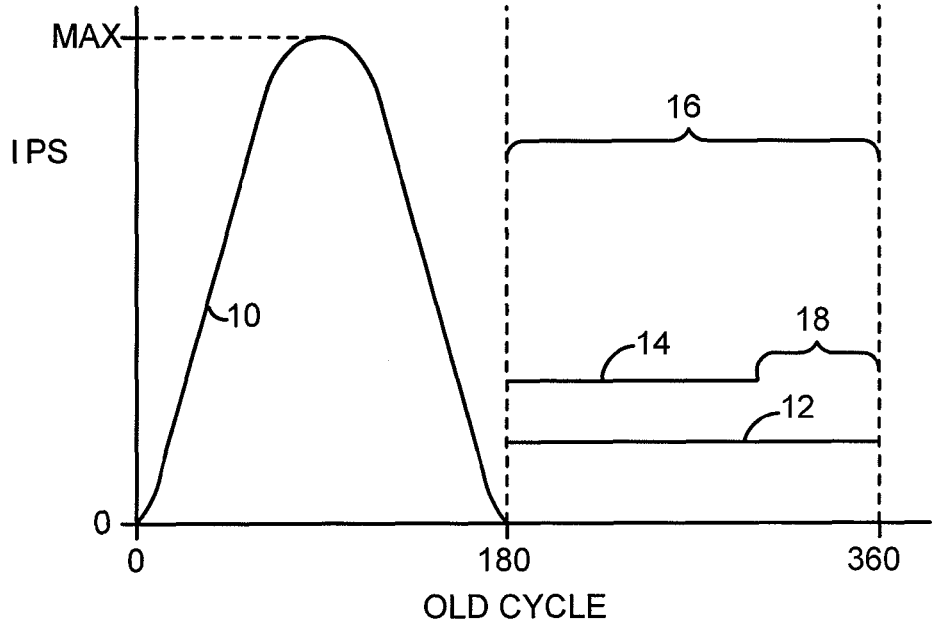
FIG.1 PRIOR ART
FIG. 1 is a chart illustrating the speed and duration of motion of a gripper chain, and the duration of collation insertions for one cycle in a conventional mail inserter.

Referring to FIG. 1, a chart is shown illustrating the movement 10 of a gripper chain in a conventional mail inserter during a single insertion cycle (measured in a 360 degree reference). FIG. 1 also shows the portion 16 of the cycle during which the gripper chain is stopped for insertion of a collation into the envelope.

Period 12 corresponds to the portion of the cycle during which the gripper chain is required to be stopped for insertion of the maximum size collation allowed by the inserter into the envelope. As shown in FIG. 1, period 12 has a duration of fifty percent of the cycle. Period 14 corresponds to an exemplary portion of the cycle in which the gripper chain is required to be stopped for insertion of a smaller size collation into the envelope. As shown, although the insertion of the smaller size collation is completed in a shorter period of time, indicated by period 14, the gripper chain in conventional devices is stopped for fifty percent of the cycle.

Thus, the period indicated at 18 is a wasted portion of the cycle in which the gripper chain is not moving, even though the insertion of the smaller size collation has been completed. This wasted portion of the cycle exists in conventional inserters because a simple AC motor is used at a constant velocity to drive the gripper chain. In addition, operators accept the inefficiency in exchange for the flexibility to easily vary the size of the collations.

Figure 2:
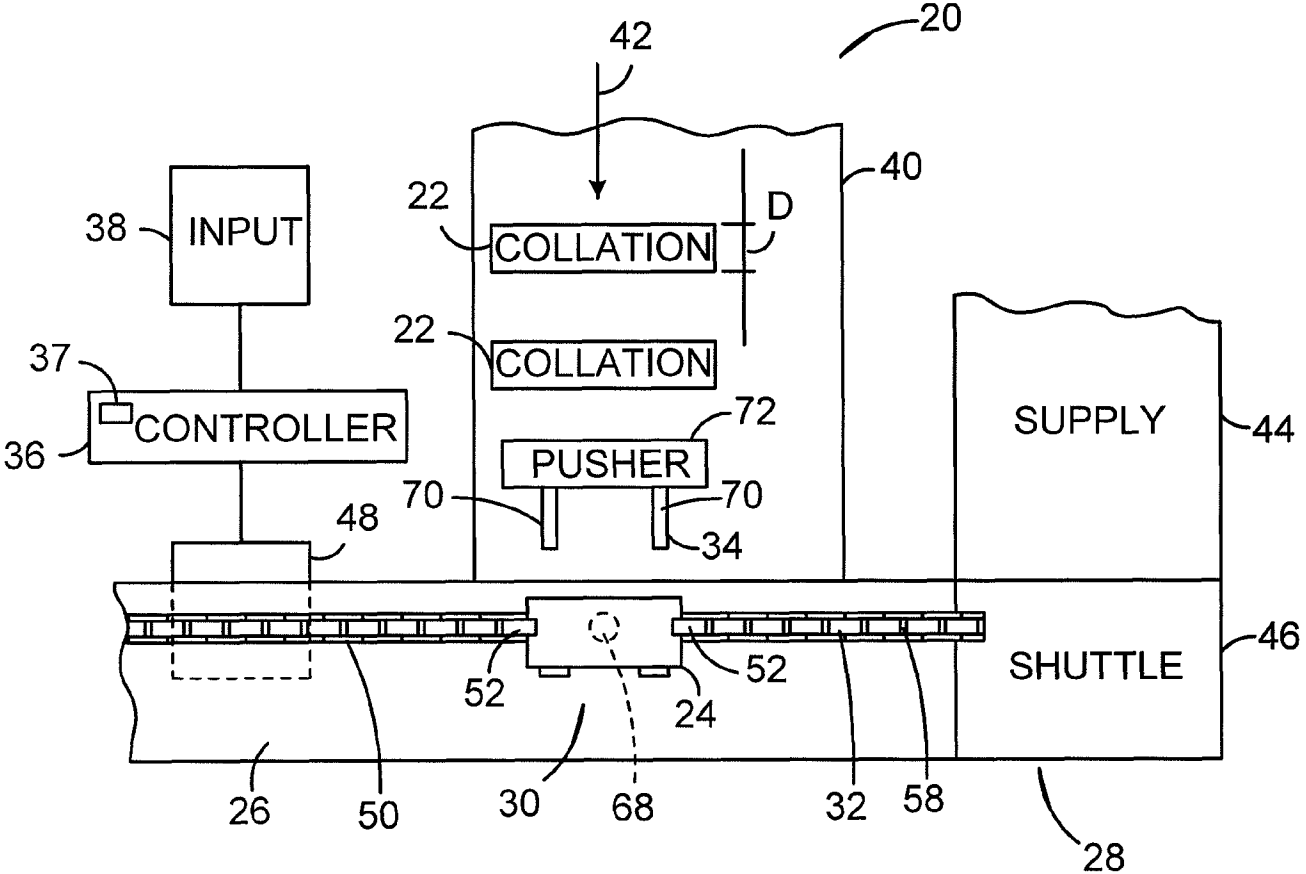
FIG. 2 is a schematic top plan view of portions of an inserter apparatus according to an embodiment of the invention.

Referring now to FIG. 2, there is shown a top view of an apparatus 20 incorporating features of the invention. Although the invention will be described with reference to the exemplary embodiments shown in the drawings, it should be understood that the invention can be embodied in many alternate forms of embodiments. In addition, any suitable size, shape, or type of elements or materials could be used.

In the illustrated embodiment, the apparatus 20 is a mail inserter apparatus adapted to insert an item, such as a collation 22 of documents, into a holder, such as an envelope 24. However, features of the invention could be used in any suitable type of inserter apparatus. The collation 22 has a depth "D," as shown in FIG. 2. The apparatus 20 comprises a deck 26, a mover 32, an opening system 34, and a controller 36. The controller 36 may include a computer having a processor and a memory 37.

The apparatus 20 may also include a user input 38 for a user to input information or select settings for the controller 36. The apparatus 20 also includes a conventional collation assembly section 40, which assembles the collations 22. The collation assembly section 40 comprises a movable deck for feeding the collations 22 towards the collation loading location 30, as indicated by the arrow 42. The apparatus 20 also includes a conventional envelope supply section 44. The envelope supply section 44 includes an envelope shuttle 46 for feeding individual envelopes from the supply section 44 to the mover 32. However, in alternate embodiments, any suitable type of item supply and holder supply may also be used.

The deck 26 is adapted to slidably support an envelope 24 from a supply location 28 at the shuttle 46 to a collation loading location 30, and subsequently off of the deck 26. The mover 32 generally comprises a drive motor 48, a conveyor 50, and a gripper 52. The conveyor 50 comprises a gripper chain in the form of a loop. However, in alternative embodiments, any suitable type of conveyor for moving the gripper 52 may be used. The gripper 52 comprises a plurality of gripper jaws attached to the gripper chain 50. The gripper jaws are adapted to open and close to grip onto ends of the envelope 24. Multiple pairs of gripper jaws are provided on the gripper chain 50 at spaced locations for greater throughput of the envelopes 24 for one revolution of the gripper chain loop.

The drive motor 48 shown in FIG. 2 comprises a position-based servo motor. In one embodiment the servo motor is a Baldor BSM90B-3150AAP, 2000 rpm max servo motor. However, in alternative embodiments, any suitable type of servo motor may be used. The servo motor 48 is adapted to vary its speed, or stop and start, as controlled by the controller 36. Unlike a simple AC motor used in a conventional inserter, the servo motor 48 allows for greater precision in positioning the motor, and/or greater precision in controlling the rotational speed of the motor's output shaft at varying speeds.

Figure 3:
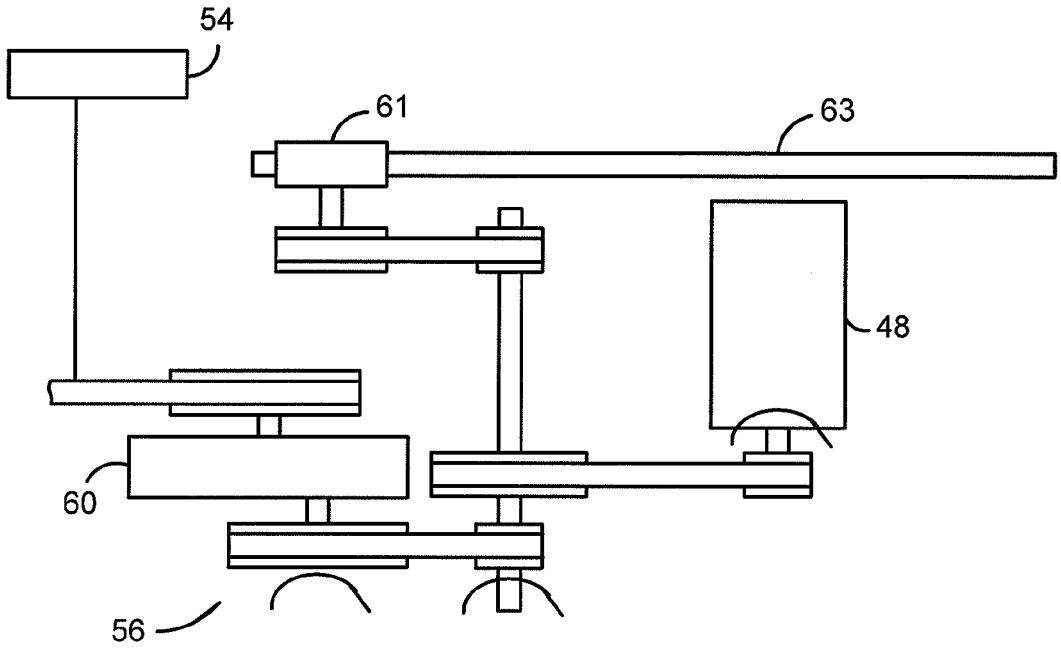
FIG. 3 is a schematic diagram of components of the invention shown in FIG. 2.

Referring also to FIG. 3, the motor 48 is connected to a chain sprocket 54 by a transmission 56. The chain sprocket 54 is connected (not shown) to the gripper chain 50 to rotate the gripper chain 50. As shown in FIG. 2, the gripper chain 50 is arranged to have a top portion located in a slot 58 of the deck 26, such that the top portion rotates through the slot 58 in an elongate path from the shuttle 46 to the opposite end of the deck 26.

The transmission 56 includes an index box 60 adapted to stop and start movement of the chain sprocket 54 even though the motor 48 might still be rotating. In this embodiment, the transmission 56 also connects the motor 48 with a cam cluster (not shown) to run the grippers and the envelope shuttle as indicated by connection 63. The transmission 56 comprises a right angle box 61 for this purpose. However, in alternative embodiments, this connection may not be provided, such as, when the grippers and/or the envelope shuttle are powered by alternative drives. Alternatively, any suitable connection between the cam cluster and the motor could be provided.

As shown in FIG. 2, the gripper chain 50 moves the envelope 24 to the collation loading location 30 from the supply location 28. The gripper chain 50 then stops, and the opening system 34 opens the envelope 24 for subsequent insertion of one of the collations 22. In one embodiment, the opening system 34 comprises a vacuum cup 68 for holding one side of the envelope, and fingers 70 that extend into the envelope 24 to enlarge the opening of the envelope. Other types of opening systems may also be used.

The grippers 52 release the envelope during insertion of the collation 22 into the envelope. With the grippers 52 released, the pusher 72 inserts the collation 22 into the envelope. The grippers 52 then re-grip the envelope and the opening system 34 is disengaged. The mover 32 then moves the assembled envelope and collation downstream along the deck 26. The larger the depth D of the collation, the longer it takes to insert the collation into an envelope. For example, it takes longer to insert a collation have a depth D of 9.5 inches into an envelope than a collation having a depth D of 4.4 inches.

Figure 4:
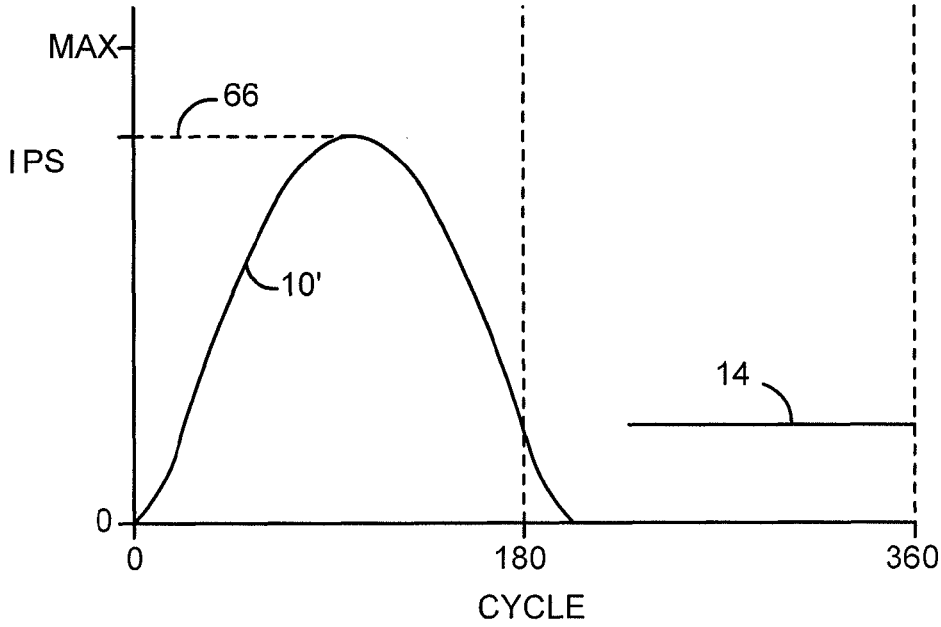
FIG. 4 is a chart illustrating the speed and duration of motion of a gripper chain, and the duration of motion of a smaller size collation insertion for one cycle in the inserter shown in FIG. 2 using an embodiment of the method of the invention.

Referring to FIG. 4, a chart similar to that shown in FIG. 1 is illustrated, but indicating a method according to an embodiment of the invention. FIG. 4 shows movement 10' of the gripper chain 50 for a collation less than the maximum size collation, and a period 14 corresponding to the time needed for the gripper chain to be stopped to insert the smaller size collation into the envelope. For the maximum size collation, movement 10 and period 12 shown in FIG. 1 would still apply, according to the invention.

With this implementation of the invention, the throughput of the envelopes and collations, for collations having less than the maximum size, is the same as a conventional inserter. However, the maximum speed of movement of the gripper chain 50 during the cycle is reduced and the duration of movement of the gripper chain 50 during a cycle is lengthened. This is done without lengthening the duration of the cycle versus the duration of the cycle in the conventional inserter shown in FIG. 1.

Figure 5:
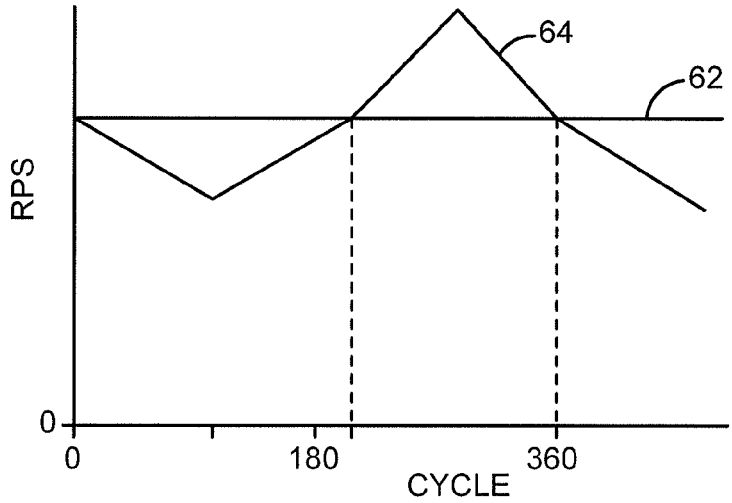
FIG. 5 is a chart illustrating speed of the servo motor of the invention, and speed of a simple AC motor at constant speed used in a conventional mail inserter.

As seen in FIG. 5, the conventional inserter uses a constant speed output 62 of its motor to its transmission. However, according to the invention, the output 64 of the servo motor 48 can be varied to reduce the maximum speed of the gripper chain and also to lengthen the duration of the movement of the gripper chain during a cycle to be more than fifty percent of the cycle. Even though an index box may be used, the profile of the servo motor operation can be designed so the chain starts and stops at the correct altered cycle positions. This profile may also allow all the insert grippers to open and close at the correct cycle positions and the envelope shuttle to move at the correct cycle positions.

As shown in FIG. 1, the speed of the movement of the gripper chain in a conventional inserter has a maximum speed (MAX) for a cycle. However, as shown in FIG. 4, the speed of the movement of the gripper chain with the invention can have a maximum speed 66 which is less than MAX. Also, the duration of movement of the gripper chain in the conventional inserter is fifty percent of the cycle (180 degrees), as shown in FIG. 1, but the duration of movement of the gripper chain with the invention is more than fifty percent of the cycle (more than 180 degrees), as shown in FIG. 4. This can be accomplished by varying the speed of the servo motor 48 as shown in FIG. 5. There is substantially no wasted time, such as period 18, shown in FIG. 1. Instead, the slower speed of the gripper chain can be used to reduce wear on the mechanical components, and also to improve reliability of the inserter. In one embodiment, the speed of the collation assembly section 40 may also be reduced and the period 14 may be lengthened.

In the embodiment described above, reliability of an inserter may be improved by reducing the speed of the gripper chain without reducing the throughput of the inserter. If the stop time is reduced as noted above, the speed of the gripper chain can be reduced without increasing the total cycle time. The chain speed can be lowered since the motion is over a greater percentage of time of the cycle (now more than fifty percent of the cycle). This may apply to inserters having a 7-inch or 14-inch pusher spacing, for example.

In some embodiments, the invention may provide a method to improve reliability of a mail inserting system and/or optimize insertion throughput on a mail inserting system. This may be accomplished by using a servo motor to drive the gripper chain and by adapting the controller to control the servo motor. The transmission between the drive motor and the gripper chain may also be adapted/modified, if desired.

In one embodiment, throughput may be increased by changing the amount of time during a cycle in which the gripper chain is stopped. The throughput would not be changed for the largest size depth collations. However, the throughput could be increased for any collations smaller than the largest possible depth collation. When using a servo motor to drive the gripper chain, the movement profile of the gripper chain may be altered, such that the stop time is based on collation depth and envelope preparation time. This is the minimum time (i.e., percentage of cycle) that the gripper chain is required to be stopped. Thus, for collations having depths smaller than the largest possible collation depth, the insertion time (e.g., when the gripper chain is stopped) can be less than fifty percent of the cycle. The smaller stop time (i.e., for collations smaller than the largest possible collation) may increase the throughput for the inserter. This is illustrated in the chart shown in FIG. 6.

Figure 6:
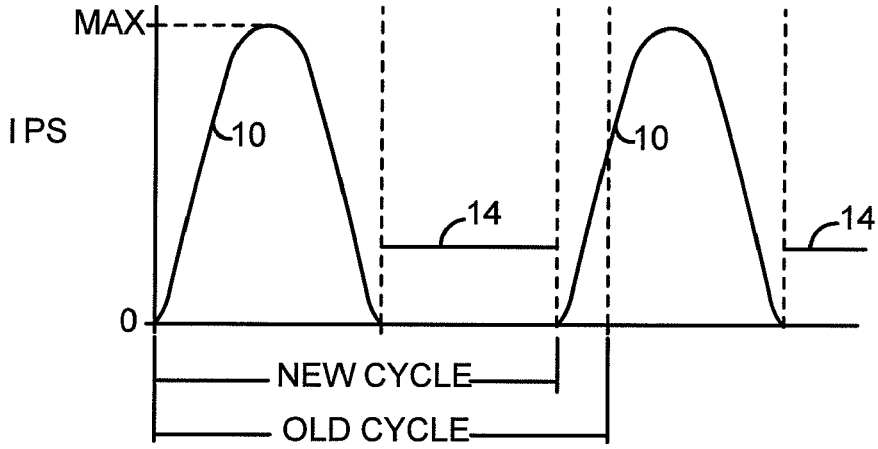
FIG. 6 is a chart illustrating the speed and duration of motion of a gripper chain, and the duration of motion of a smaller size collation insertion for one cycle in the inserter shown in FIG. 2 using a further embodiment of the method of the invention.

As shown in FIG. 6, the movement 10 of the gripper chain 50 is the same speed and duration as illustrated in FIG. 1, but the new cycle is shorter in duration than the old cycle. This is because the subsequent new cycle occurs at the end of the period 14 without the wasted period 18. Thus, over time, the throughput of the inserter for collations having depths smaller than the largest depths may be increased.

In another embodiment, reliability may be improved by reducing the speed of the gripper chain movement and throughput may simultaneously be increased by making the total cycle time shorter. Thus, the slower speed of the gripper chain and a shorter total cycle time are not mutually exclusive features.

The invention may be used to change the insertion ratio during a cycle from the customary 1:1 insertion ratio (e.g., stop time:movement time) to a different ratio, such as 1:1.2 for example. Changing the insertion ratio may provide several advantages, such as reduced speed and reduced forces on the mechanics and improve improved reliability, such as at 14,000 collation/hour speed, for example. In addition, with an altered insertion ratio profile, the inserter speed may be raised, such as to 16,000 Collations/Hour in a 14 inch pusher spacing for a 6"×9" envelope with a half fold, for example. Further, there may be no requirement for a change over between 7-inch and 14-inch pusher spacing. The invention may operate with a 7-inch and 14-inch pusher spacing, or may be left in 14-inch mode only. Finally, embodiments of the invention may operate with an inserter having two, three, or four overhead pushers.

Figure 7:
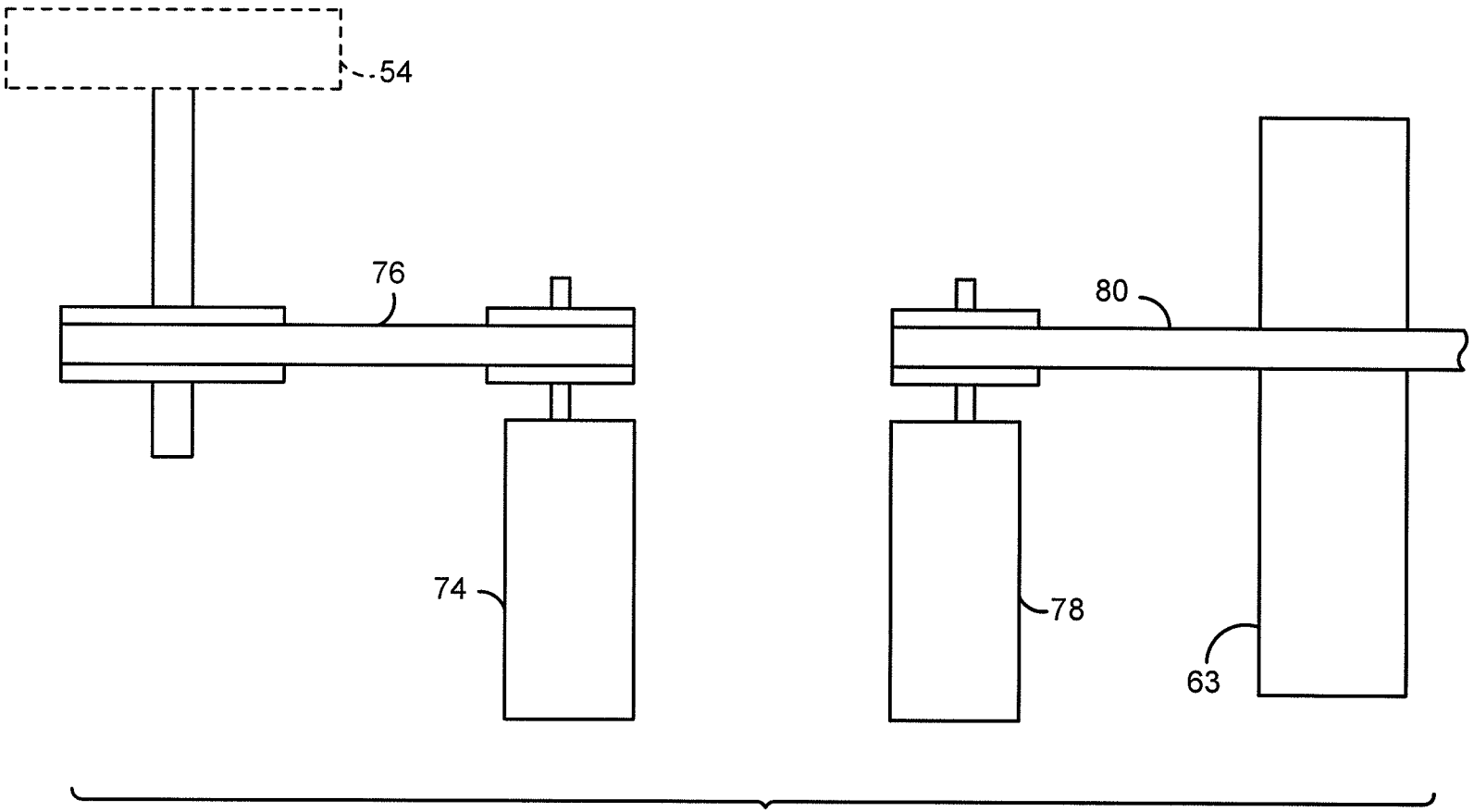
FIG. 7 is a schematic view of an alternative embodiment of the components of the invention shown in FIG. 3.

An inserter according to embodiments of the invention may be designed with one servo motor or with two or more servo motors. A one-motor version has been described above with reference to FIG. 3. Referring also to FIG. 7, an embodiment using two servo motors is shown. In this embodiment, the first servo motor 74 is connected to the chain sprocket 54 by a transmission 76. In this embodiment, the transmission 76 does not include an index box. The second servo motor 78 is connected by a transmission 80 to a cam cluster (not shown) to run the opening and closing of the grippers 52 and the envelope shuttle 46. In another embodiment, the second servo motor 78 could merely be used to operate the grippers 52, and a third servo motor (not shown) could be used to operate the envelope shuttle 46.

Figure 8:
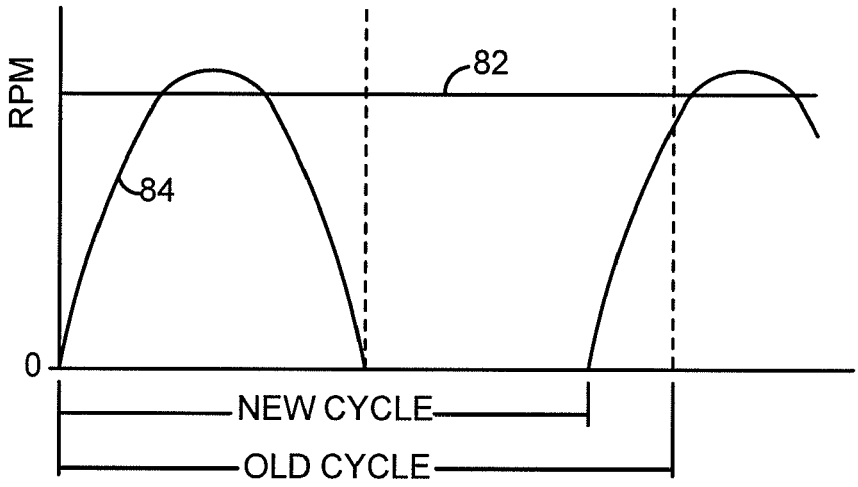
FIG. 8 is a chart illustrating the speed of the servo motor for an embodiment of the invention utilizing the components shown in FIG. 7.

Referring also to FIG. 8, because the transmission 76 does not include an index box, the stopping and starting of the movement of the gripper chain 50 is controlled by stopping and starting the operation of the servo motor 74. FIG. 8 shows the output 82 of the simple AC motor at a constant speed used in a conventional inserter, and the output 84 of the servo motor 74. This chart illustrates the increased throughput for the smaller depth collation corresponding to FIG. 6. However, the stopping and starting of the movement of the gripper chain 50 by controlling the stopping and starting operation of the servo motor 74 may also be carried out at a slower speed in a throughput method similar to that shown in FIG. 4. Alternatively, this could be used with higher throughput and slower speed, but within the same time frame as the cycle in the conventional inserter.

Figure 9:
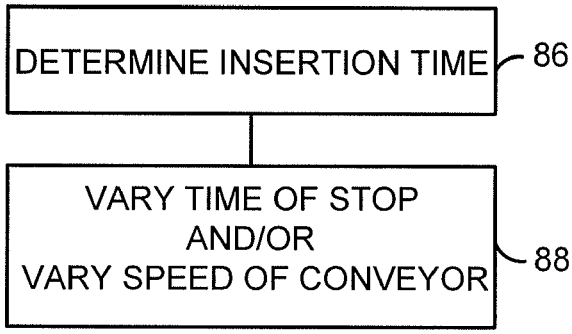
FIG. 9 is a block diagram illustrating an embodiment of the method of the invention.

Referring also to FIG. 9, an embodiment of a method of the invention comprises determining an insertion time, as indicated by block 86, for inserting one of the collations 22 into the envelope 24. The insertion time can be determined based upon information input by a user into the input 38, or information obtained by scanning or detecting a depth D of the collation 22, for example.

For example, in one embodiment, the controller 36 comprises a lookup table for determining the insertion time based upon a selection by the user at the input 38 of the size of the collation 22 and/or the size of the envelope 24. This determination is used to determine period 12 or 14. The controller 36 is then programmed to select the speed and duration of the movement 10 or 10' (see FIGS. 1 and 4) based upon the length of the determined period 12 or 14.

Alternatively, or additionally, the controller 36 may be programmed to increase the throughput of the envelopes and collations based upon the determined period being less than period 12. Thus, as illustrated by block 88 in FIG. 9, the illustrated embodiment of the method comprises varying the time of the stop of the gripper chain and/or varying the speed of the gripper chain. The programming for performing the methods may be stored in the memory 37, and/or stored on a portable program storage device connected to the controller 36, such as for loading the programs into the memory 37, for example.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An inserter apparatus for inserting an item into a holder, the inserter apparatus comprising:

a deck for slidably supporting the holder from a first location to an item loading location;

a mover for moving the holder along the deck, wherein the mover comprises:

a servo motor;

a conveyor connected to the servo motor; and a gripper connected to the conveyor, wherein the gripper is adapted to grip onto the holder at the first location and move the holder along the deck with the conveyor as the conveyor is moved;

an opening system at the item loading location for opening the holder and inserting the item into the holder; and a controller connected to the servo motor to vary a speed of the servo motor to thereby vary movement of the conveyor and the holder along the deck wherein the controller comprises a computer; and wherein the mover does not comprise an index box connecting the servo motor to the conveyor, and wherein the controller is adapted to stop movement of the conveyor by stopping movement of the servo motor to thereby substantially stop movement of the holder during insertion of the item into the holder at the item loading location.

2. The inserter apparatus of claim 1, wherein the conveyor comprises a chain.

3. The inserter apparatus of claim 1, wherein the gripper comprises jaws configured to grip the holder.

4. The inserter apparatus of claim 1, wherein the holder comprises an envelope, and wherein the deck is configured to support the envelope.

5. The inserter apparatus of claim 4, wherein the opening system comprises fingers configured to be inserted into the envelope and open the envelope for insertion of the item.

6. The inserter apparatus of claim 1, wherein the controller is adapted to select the speed of the servo motor based at least partially upon an amount of time needed for full insertion of the item into the holder at the item loading location.

7. The inserter apparatus of claim 6, wherein the controller is adapted to determine the amount of time needed for full insertion of the item into the holder based upon a depth of insertion of the item into the holder.

8. The inserter apparatus of claim 7, wherein the controller is adapted to determine the depth of insertion of the item into the holder based upon an input by a user into the controller of at least one of a size of the item and a size of the holder.

* * * * *